United States Patent [19]

Leschot

[11] Patent Number: 4,850,558

[45] Date of Patent: Jul. 25, 1989

[54] DEVICE FOR SUPPORTING AN INSTALLATION VERTICALLY DISPLACEABLE ALONGSIDE A PROFILE

[75] Inventor: Georges-André Leschot, Commugny, Switzerland

[73] Assignee: Aldo Orlandi, Switzerland; a part interest

[21] Appl. No.: 124,823

[22] Filed: Nov. 24, 1987

[30] Foreign Application Priority Data

Nov. 24, 1986 [CH] Switzerland ..... 4691/86

[51] Int. Cl.[4] ..... E04G 3/00

[52] U.S. Cl. ..... 248/297.1; 248/123.1

[58] Field of Search ..... 248/297.1, 669, 123.1, 248/124, 125; 211/126; 361/331

[56] References Cited

U.S. PATENT DOCUMENTS

| | | | |
|---|---|---|---|
| 400,911 | 4/1889 | Hall | 248/297.1 X |
| 1,371,011 | 3/1921 | Waite | 248/297.1 |
| 1,470,698 | 10/1923 | Nelson | 248/123.1 |
| 2,841,634 | 7/1958 | Kimball | 248/159 X |
| 2,901,202 | 8/1959 | Stava et al. | 248/669 X |
| 2,967,458 | 1/1961 | Stone | 248/123.1 X |
| 4,092,707 | 5/1978 | Millerbernd . | |
| 4,496,057 | 1/1985 | Zenitani | 211/26 |

FOREIGN PATENT DOCUMENTS

| | | |
|---|---|---|
| 313788 | 3/1974 | Austria . |
| 2400479 | 3/1979 | France . |
| 638161 | 9/1983 | Switzerland . |

*Primary Examiner*—J. Franklin Foss

*Attorney, Agent, or Firm*—Ostrolenk, Faber, Gerb & Soffen

[57] ABSTRACT

A device for a vertically displaceable installation support comprising a profile such as a pole, having an internal passage for electric conductors and for carriage entrainment means; a slide rail fixed alongside the profile; a pole head fixed with adjusting means relative to the slide rail at the top of the profile; a movable carriage; a mobile locking, stabilizing and unlocking system fixed to the carriage and corresponding stationary parts on the pole head; electric connections comprising male elements on the carriage and female ones on the pole head; a position and operation monitoring flag on the pole head, and a support for the installation such as a lighting bar. The carriage is slidingly mounted on the slide rail.

A spring operated emergency brake may be fitted on the carriage to slow it down and lock it on the slide rail should the entrainment means break or unduly loosen.

14 Claims, 4 Drawing Sheets

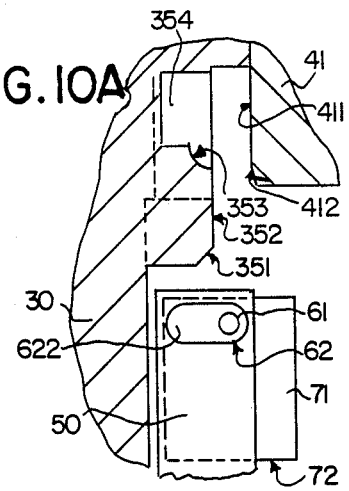
FIG. 10A
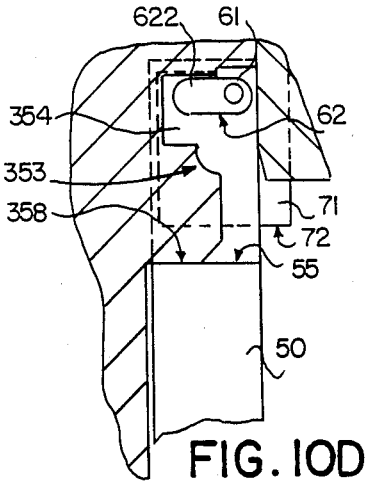
FIG. 10D
FIG. 10B
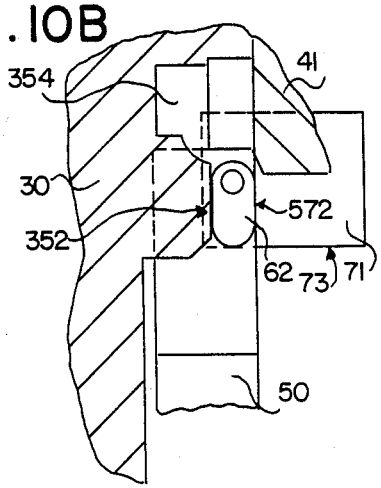
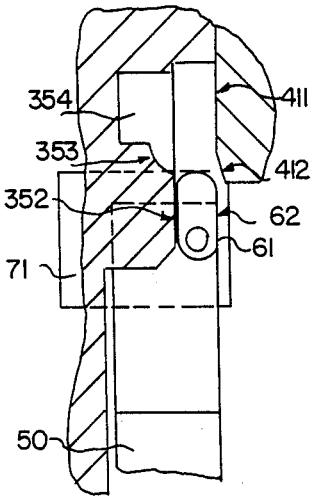
FIG. 10E
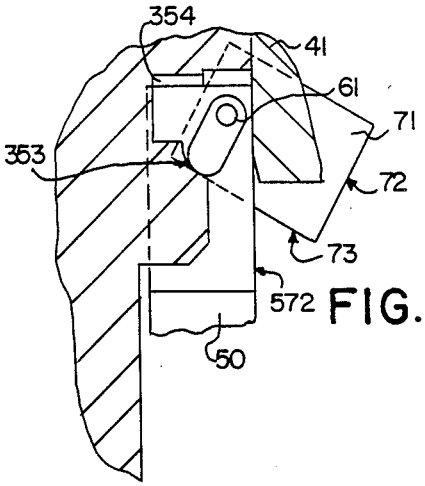
FIG. 10C

DEVICE FOR SUPPORTING AN INSTALLATION VERTICALLY DISPLACEABLE ALONGSIDE A PROFILE

The present invention belongs to the field of devices for supporting installations which must be raised at a certain height over the ground, particularly on a pole, said systems comprising a support to be raised and lowered from the ground to said height and vice versa.

The installations or devices to be mounted on the vertically displaceable support are, for example:

lighting points or arrays such as projectors, antennas of any kind, supervision and monitoring devices such as cameras, microphones, infrared receptors for fire detection or any other alarms, measuring devices in the field of meteorology, measuring and monitoring devices for environmental data such as for smoke, gases, etc., advertisement devices.

In the following description, reference is made to lighting bars. However, it remains clear from the above that any other installation may be used together with the vertically displaceable system.

By the term "vertically displaceable", any movement between a low position, i.e. near the ground, and a high position, at a height exceeding about 2 meters, and vice versa, is to be understood. The displacement may be realized alongside a true vertical path or any inclined one, even along a curved path. The displacement may be effected on a pole, along a wall, or along any solid structure having a vertical extension.

Lighting systems, such as installations for illuminating public areas, for examples sport stadiums, or harbor installations, comprising poles bearing at their summit one or more lighting bars, have already been used. Systems have been developed which slide on a pole and allow to lower the lighting bars on the pole to the ground in order to effect all maintenance and repair operations and to facilitate these operations from the viewpoints of rapidity of intervention, a reduced labor cost, and to avoid accidents.

The dimensions of the known systems permit to support lighting bars and other installations having a weight of from 500 to 1500 kg, sliding on poles weighing from 10 to 30 tons, to a height of about 50 to 60 m above the ground. Systems have already been developed for these dimensions, comprising:

means to raise and lower a displaceable unit at least indirectly on the pole, blocking and latching means on said unit, at any vertical position, when the entrainment means are defective, and electric connecting means when the said unit is in its uppermost end position, whereby the mechanical strain of feeding cables is eliminated.

French patent specification No. 2,400,479 discloses a device for raising a load along a vertical rail by means of a cable fixed to a carriage comprising the unit to be raised, and containing a brake device for slowing down and blocking the carriage on the rail should the cable break. This device distinguishes in that the carriage comprises guide rollers sliding within a T-shaped groove of the vertical rail with the guide roller axes being perpendicular to the T stem, and the brake shoes of the brake unit inserted into the T-shaped groove of the rail. Furthermore, the cable, fixed to a brake lever of the brake unit, passes on deflection rollers running in the T-shaped rail groove.

Swiss patent specification. No. 638,161 discloses a device formed by a pole and a support slidingly mounted alongside the pole, and a which is situated at the pole basis to displace the support from the basis of the pole to its summit and vice versa. The support comprises an automatic braking device cooperating with the pole, said device being sensitive to the relative speed between itself and the pole.

These systems, which may support some tens of projectors on a sole pole, are adapted to lighten very extended areas.

It is a first and important object of this invention to provide a support for installations of the type described above, in particular adapted to more restricted dimensions: load of the installation about 150 kg, distance from the ground about 15 to 20 m. The device should be capable of illuminating areas such as football stadiums, tennis courts, highways, crossings, squares, railway and bus stations, parking lots, etc.

There is another object of the invention to provide a vertically displaceable system of the described size which allows to reduce the cost of maintenance and repair of the said installations since these operations could be done on the ground by one sole person and without special devices such as elevator platforms or fire ladders, and further independently from wheather conditions, the maintenance being easier, it can be done in regular intervals, without waiting for an emergency brakedown before intervention.

Still another object of the invention is to provide a vertically displaceable system wherein any appropriate electrical hardware can be used without the need of any adaptation of the system to every country's standards.

Still another object of this invention is to provide a device for supporting an installation of the kind described above, vertically displaceable alongside a profile such as a pole, comprising:

(a) an elongated carriage addapted to support said installation and including locking, stabilizing and unlocking means in the raised end position of the carriage, (b) carriage entrainment means, (c) a slide rail for the carriage situated at the exterior of said profile substantially in vertical position, including at least one groove adapted to cooperate at least indirectly with a brake system fixed on said carriage, and (d) a head mounted at the summit of said profile, said carriage entrainment means as well as electrical conductors to be connected to said installation, passing through the interior of said profile.

These objects are met and implemented by the device of the invention wherein said carriage comprises male electric connection means as well as locking, stabilizing and unlocking means to be activated when the carriage is in its uppermost position, The head comprises female electric connection means cooperating with said male connection means, when said carriage is in its uppermost end position. The slide rail is connected to said head which includes position adjusting means relative to the end portion of the slide rail and furthermore fixed elements adapted to cooperate with said locking, stabilizing and unlocking means of the carriage.

In the following description and in the drawing, the said profile is shown to be a cylindrical or conical pole. However, the profile may also be another means than a self-supporting one and may then be fixed to a facade or a wall without leaving the scope of this invention.

It is prefered that the guide rail is composed of a plurality of sections having different standard lengths and adapted to be fixed in end-to-end relationship, for example by joining pins, to obtain all possible heights by means of modular elements.

The locking and stabilizing means function, when the carriage is in its uppermost position, under the action of gravity on a counterweight which also serves as a position flag thus allowing to monitoring the locking, stabilizing and unlocking operations from the ground. In addition, the flag allow to check the correct insertion of the electric connectors.

Furthermore, the carriage may be completed by a parachute brake system to function in case of a rupture of the entrainment means, for example a cable. This system comprises a spring driven device which controls the action of at least one brake shoe onto the guide rail when the entrainment cable breaks or unduly loosens.

The invention will now be explained in greater detail by means of the following description of preferred embodiments which are however not to be construed to limit the invention.

In the drawing:

FIG. 6 is an end view of the brake system, with a partial cross sectioned representation of the brake shoes in blocking position;

FIG. 7 is a view from below of the brake system, in sliding position;

FIG. 8 is a cross sectional view of the brake system along the axis of the pole, in sliding position; and FIG. 9 is a cross sectional view of the brake system along the line IX—IX in FIG. 6, showing in full lines the brake shoes in blocking position and in dashed lines the sliding position of the system;

FIG. 10 is an enlarged view of parts represented in FIG. 4, illustrating the functions of locking, stabilizing, and unlocking the carriage on the pole head. More particularly:

FIG. 10A represents the sliding up or down

FIG. 10B, the engagement

Figure 4:
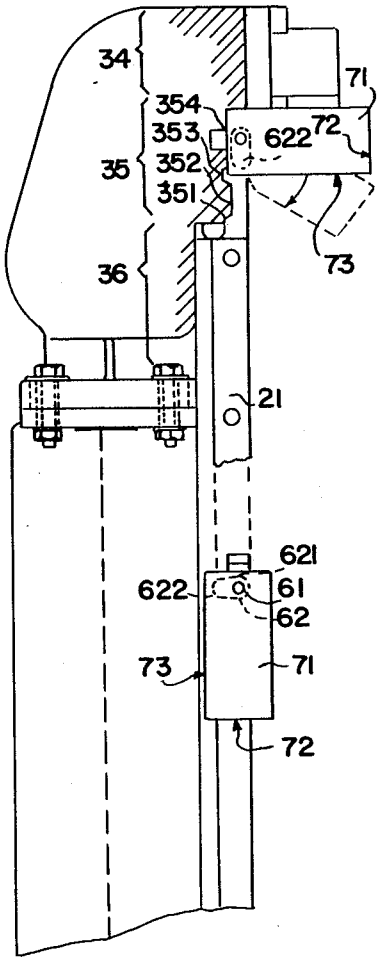
FIG. 4 is a lateral view of the engagement position flag of the mobile portion, represented sliding up or down in its inferior part and in the engaging phase in its superior one.

FIG. 10C, the locking and stabilizing phase

FIG. 10D, the unlocking phase, and

Figure 11A:
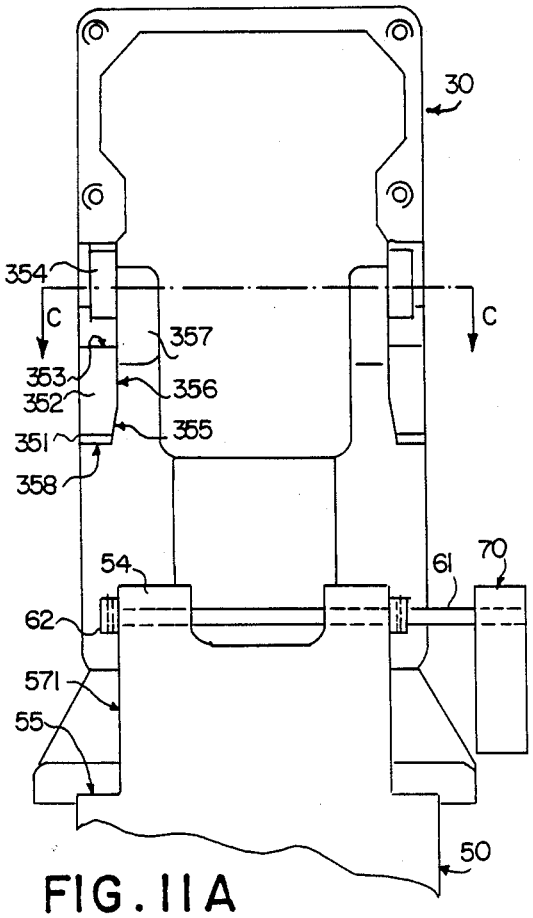
Figure 11B:
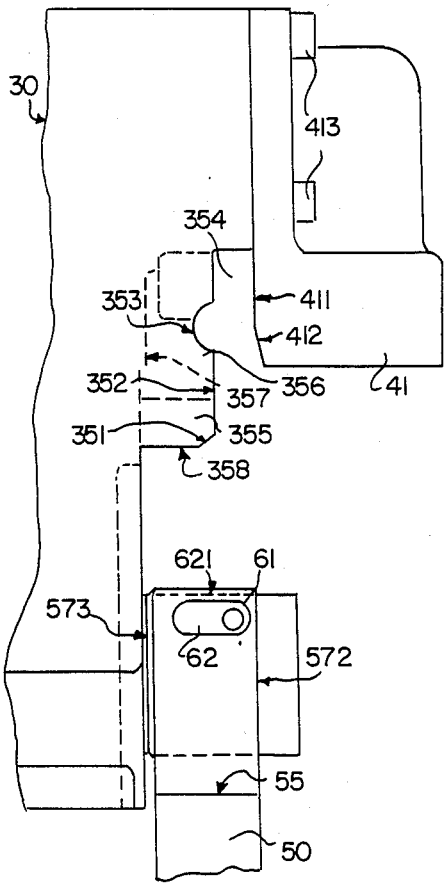
Figure 11C:
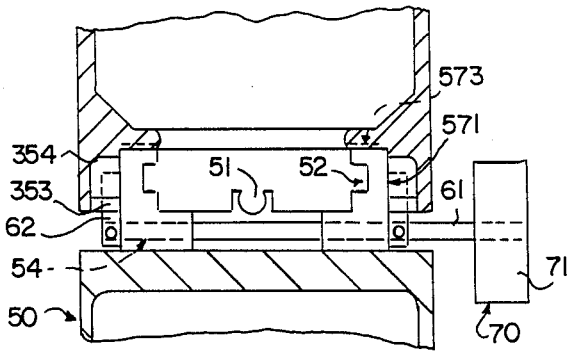

FIG. 10E, the, disengagement;

FIG. 11 shows a detail of the pole head and of the carriage in the up or down motion phases (for sake of clarity, the guiding rail, the entrainment cable and its deflecting mechanism are not shown in the drawing), respectively represented:

a front view in FIG. 11A, a lateral view in FIG. 11B and a cross sectional view (along C—C of FIG. 11A) in FIG. 11C.

In the FIGS., identical reference numerals design identical or analogous elements.

Figure 1:
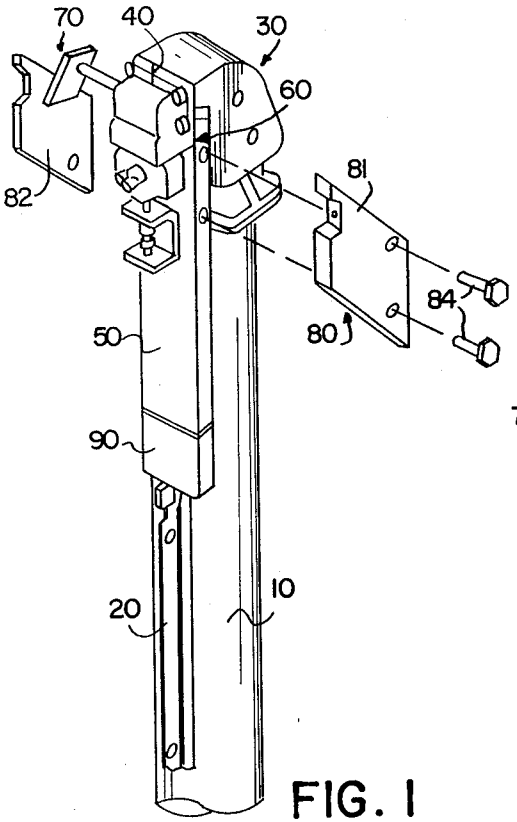
FIG. 1 is a perpective view of the upper end portion of a pole, showing the fixed head, the sliding carriage and the electrical connecting means (the carriage is fixed and stabilized in its high position, and its electrical contacts are connected)

The general and more schematical representation of FIG. 1 shows a pole 10 having fixed thereon over substantially its entire length, a sliding rail 20. A pole head 30 is mounted, as it will be explained later, on the summit of the pole 10. The pole head 30 has further fixed thereon a portion of electrical connexion elements 40.

The slide rail 20 is adapted to allow the sliding movement of a carriage 50, bearing locking means 60 for the head 30, and a locking position flag 70, allowing the visual check, from the ground, of the engagement phase of the mobile pieces with the fixed ones. The carriage 50 further bears support parts 80 for installations, for example an array of projector lamps (not shown), regularly spaced around the pole. The carriage 50 further carries part of the electric connexion elements 40 to cooperate with connection parts fixed to the pole head 30.

According to a particularly important embodiment, the lowering system of this invention may be equipped with a parachute emergency brake system 90 for stopping and blocking the carriage in any position should the entrainment cable break or underly loosen. The cable will be described later.

The principal parts of the vertically displaceable installation support of the invention will now be described in greater detail.

Figure 3:
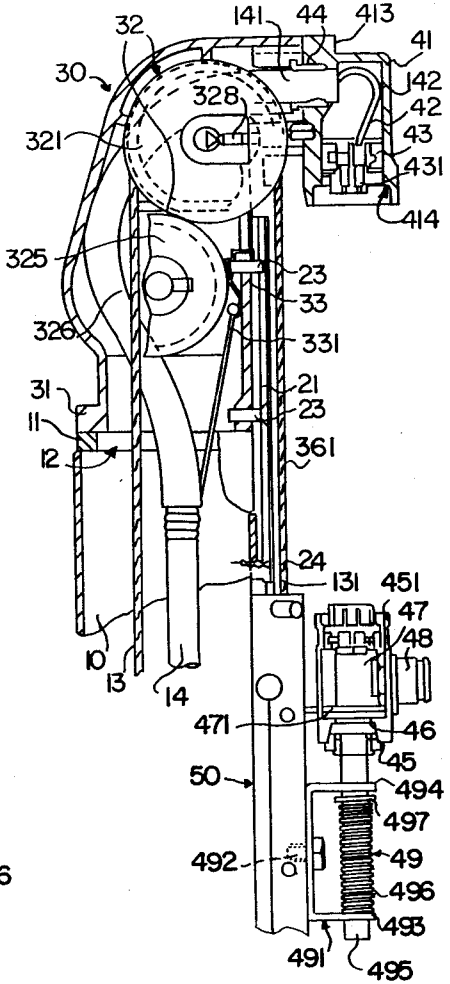
FIG. 3 is a lateral view of the pole (the carriage is in an intermediate position) with some details in cross section.
Figure 2:
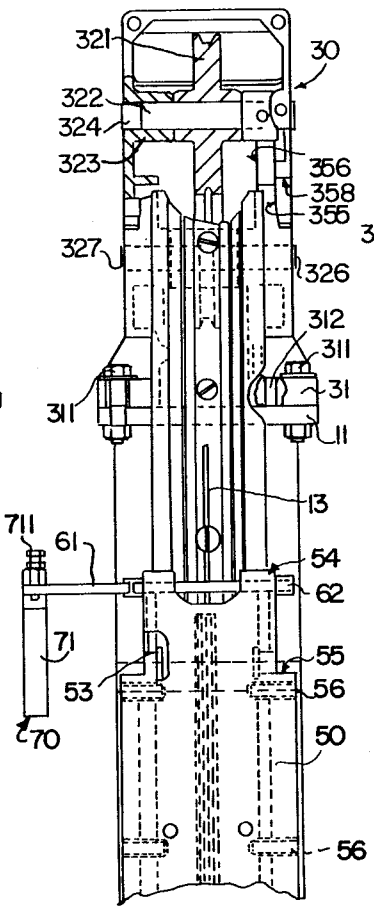
FIG. 2 is a front view of the components of FIG. 1, with some details shown in cross section (the carriage is in an intermediate position)
Figure 8:
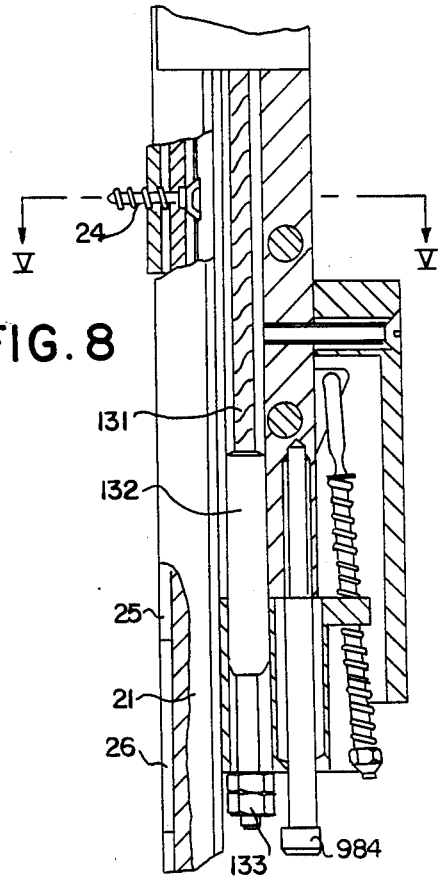
Figure 9:
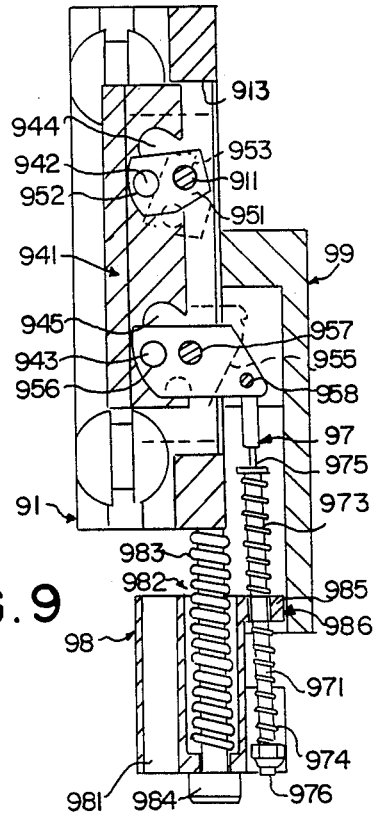

In FIGS. 2 and 3, the pole 10 is shown to be ended by a plate 11, for example welded thereon, having a central opening 12 to allow the passage of an entrainment cable 13 and of electric feeding conductors 14. Cable 13 is either fixed to the lower portion of the pole 10, which improves security, or wound on the drum of an entrainment winch (not shown). In the first case, the entrainment is accomplished by a mobile winch adapted to be inserted into special openings in the pole 10. The upper end 131 (FIG. 3) of the entrainment cable 13 is connected to the sliding carriage 50. As it is shown in FIG. 8, this end can be pinched into a threaded rod 132, and the whole is blocked in the carriage by a nut and counter nut 133. The electric feeding conductors 14 serve to power the installations from the ground and, furthermore, to transmit information from and towards these installations.

Figure 5:
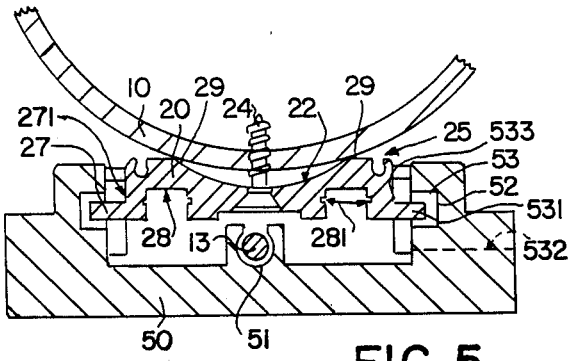
FIG. 5 is a transversal cross sectional view of the pole, along the line V—V in FIG. 8, representing the carriage sliding on its rail and, partially, a pole.
Figure 6:
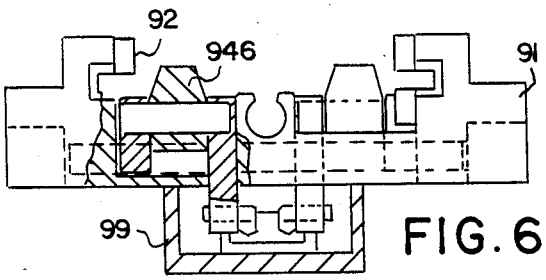
FIGS. 6 to 9 show a parachute emergency brake system to prevent the fall of the sliding carriage and of the supported installations. More particularly.
Figure 7:
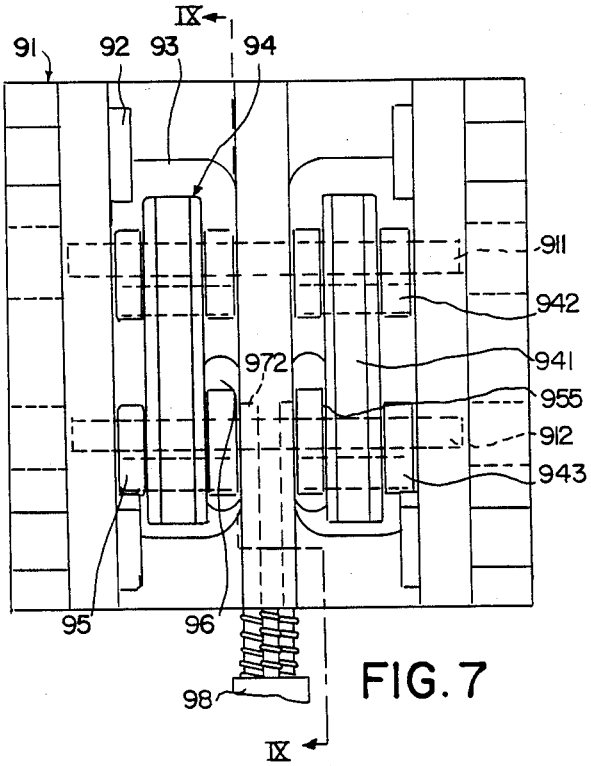

The sliding rail 20 is composed of rail sections 21 of standard length in abutting relationship to cover substantially all the length of the pole. The profile of the rail 20 may best be seen in the section of FIG. 5. The surface to be fixed against the pole has a curvature 22 followed on both sides by two contact edges 29 which bring about the parallelism of the rail and the pole and serve as adaptation means to poles of different diameter or of a variable diameter should the pole be conical. The rail sections 21 are fixed to the pole by a number of central screws 23 and 24, spaced along each section. In the drawing, the uppermost rail section is mounted on the pole head 30 by threaded screws 23 in corresponding internal screw threads to guarantee the precise entry of the carriage into the pole head and, consequently, the correct functions of locking, stabilization, and unlocking. Over the length of the pole, the rail sections are fixed by self tapping screws 24. Two abutting rail sections are joined together by two cylindrical assembling grooves 25 for receiving, at the end of each rail section, two joining and adjusting pins 26 (see FIG. 8). In FIG. 5, it can be seen that the sliding rail 20 has furthermore two lateral wings 27 showing two supporting surfaces 271 for indirect guiding of the carriage 50. The rail 20 comprises further, on its outer surface away from the pole, two grooves 28 for cooperation with brake shoes; the section of the grooves is preferred to be that of a regular trapezoid. The undermost rail section may be fitted with two stop blocks for the displaceable support, and the uppermost rail section two reset pins for suppressing the effect of the parachute brake (pins not shown). Furthermore, each groove 28 has two slots 281 to receive a steel slide ribbon which can be pushed from the ground against the carriage in the pole head, for capturing and triggering it should the carriage, exceptionally, remain blocked at any elevated position. The sliding rail may be made of extruded aluminum.

The pole head 30, made for example of cast aluminum, comprises a base 31 fixed to the plate 11 by four bolts 311, after alignment by a hexagon socket screw 312. Within the head 30, the entrainment cable 13 goes over pulleys 32, comprising a support pulley 321 mounted on a shaft 322 fixed to the head 30 with one of its ends by a screw 328. The shaft 322 is journalled in borings 323 of the lateral flanges of the head 30. Pulley 321 is, for example, made of polyamide to improve sliding and to avoid any corrosion. In order to avoid the entry of water or foreign matter (animals, dust) into the head 30, the said borings are closed by levelling stoppers 324 of synthetics such as polyethylene. Should the pole 10 have a smaller inner passage than that shown in the drawings, a second, deflecting pulley 325 may be provided which is mounted on a shaft 326 with its ends protected by two stoppers 327. Since the electrical feeding conductors 14 go also through the head 30, the latter may be fitted with a hook 33 to receive an attachment cord 331 for the feading conductors of the stationary connector 41. The cord 331 may be replaced by a portion of the conductor sheath. For the sake of clarity, the front face of the head 30 will be described in three parts. The upper part 34 will receive the housing of the stationary connector 41, to be described later. The mid portion 35 is adapted to fulfill three functions:

the operation of locking and stabilizing, as well as unlocking of the carriage 50, the fine guiding of the carriage 50 before locking, and elevation limit stop of the carriage. The lower part 36 receives the upper end of the uppermost sliding rail section and is therefor fitted with inner threads 361. The mid portion 35 is shown to comprise the following parts, making reference to FIGS. 3, 4, 10 and 11:

(a) regarding the functions of locking and stabilizing:

an engaging angle 351, a sliding plane 352, a rounded rest surface 353, a spacing recess 354, a lengthwise surface 411 for the fine guidance and the stabilization of the carriage, this surface being part of the housing 41;

(b) regarding the fine guidance of the carriage:

a lateral engaging surface 355 (see FIG. 11), a lateral surface for the fine guidance 356, a lengthwise engaging surface 412 (part of the housing 41 for stationary connectors)

a lengthwise surface 411 for the fine guidance and the stabilization, a rear lengthwise surface 357 for the fine guidance;

(c) and regarding the elevation limit stop:

a stop surface 358. All these functional recesses and surfaces are on both sides of the head.

The device for electrical connection 40 comprises a housing 41 for the stationary connector, adapted to be fixed by the bolts 413 to the upper part 34 of the head 30. Further to its basic electrical function, the housing 41 effects by its engaging surfaces 411 and 412 the engagement, the fine or terminal longitudinal guidance and the stabilization of the carriage (see FIGS. 3 and 11). It is shown in FIG. 3 that the housing comprises a chamber 42 to receive a female multiple connector socket 43, known per se, as well as at least one opening to mount a stuffing box 44 to maintain and render tight the end portion 141 of at least one electrical feeding conductor 14. Thus, the conductor leads 142 are fully protected within the housing 41, and their ends are pinched in a known manner in the female contacts 431. An analoguous distribution is found in the housing 45 of the mobile connector, having a chamber 46 to receive a male multiple connector socket 47 corresponding to the female socket 43, and a stuffing box 48 holding the electrical feeding connectors of the devices or installations not shown in the drawing. Two adjusting screws 471, placed at the two sides of the connector housing 45 and one of which slides with its end on the surface of the carriage, allow the alignment of the entry of the latter into the stationary housing 41. The mobile connector housing 45 has a gasket 451 which will abut against the contact surface 414 of the stationary housing 41. The housings of the stationary and mobile connectors 41 and 45, respectively, may be made of cast aluminum. At the lower portion of the mobile connector housing 45, there is a device 49 to fix the mobile connector 45 to the carriage 50. The fixation device 49 comprises a bracket 491 screwed by bolts 492 to the carriage 50, the bracket wings 493 and 494 having passages for a rod 495 mounted with sliding movement and surrounded by a helical spring 496, fixed with its upper portion 497 to the rod 495 and abutting with its free end to the lower wing 493 of the bracket 491.

The movable carriage 50 is adapted to slide along the sliding guide 20. As shown in FIG. 5, its profile has a passage 51 for the entrainment cable 13 whose one end 131 is fixed by any known means to the lower portion of the carriage. This is important since the cable may be replaced without any dismantling when the carriage is on rest on its lower abutment or blocked by the parachute brake. The section of carriage 50 shows two clearance grooves 52 for the guide rail. Four cylindrical guide means 53 of synthetic material, having a guiding groove 531 for the passage of the wings 27 of the rail, and a surface 533 which will bear upon the corresponding surface 271 of the guide rail, are provided to obtain the sliding and the guidance of the carriage 50 on the sliding rail 20. The guide means 53 are arranged on the upper and lower portions of the carriage. It is important that, in particular for poles comprising several sections overlapping at the joining portions with extra thicknesses of about 5 mm, the sliding rail will follow the deformation of the pole at these extra thicknesses. In order not to alter the sliding of the carriage 50, the carriage guide means 53 are arranged in cylindrical borings 532 (FIGS. 2 and 5). Thus, when the carriage goes over such an overlapping, it will meet a change in the curvature of the sliding rail: the guide means 53 may undergo slight rotations thus avoiding any jamming of their groove 531 on the wings 27 of the sliding rail. On its upper portion, the carriage comprises a transversal boring 54 for the passage of a hook shaft, two abutting surfaces 55, and further inner screw threads 56 for the mounting of support 80 for utilization devices. As it has already been mentioned, the pole head comprises surfaces defining a recess adapted to receive the upper portion of the carriage, with appropriate play. More particularly (see FIG. 11), there are the following corresponding surfaces (the numerals in brackets are those of the head and the stationary housing):

571 (356) lateral surface of fine or terminal guidance,

572 (411) longitudinal surface of terminal guidance and stabilization of the carriage,

573 (357) longitudinal rear surface of terminal guidance of the carriage.

As to the rough carriage guidance, this is accomplished by the carriage guide means 53 sliding on the guide wings 27 of the rail and the resting surfaces 271.

The elements of the locking and stabilization as well as unlocking system 60 on the carriage 50 are composed by a hook shaft 61, mounted pivotably in the boring 54 of the carriage, bearing on both sides of the carriage two suspension hooks 62 formed by an eccentric having two plane guide surfaces 621 and a pivotable, rounded end 622 to be described later.

As shown in FIGS. 2, 10 and 11, the hook shaft 61 protrudes on one side of the carriage to permit the fixation of the locking position flag 70. This flag 70 comprises a counterweight 71, preferably composed of a rectangular plate whose lateral surfaces visible from the ground are paint with different colors allowing to check the position of the system. For example, the small face 72 may be red whereas the large face 73 is black. The counterweight 71 is fixed to the shaft 61, e.g. by a bolt 711.

The installation support system 80 is schematically shown in the drawing by its lefthand plate 81 and its righthand plate 82, fixed by bolts 84 in the screw holes 56 threaded into each side of the carriage. These plates 81 and 82 may be part of a straight tie bar, or of a crown elements, according to the nature of the installation to be used.

According to a particular important embodiment, the movable carriage 50 may be fitted with a parachute brake system 90 such as shown in FIGS. 6 to 9. The frame 91 of the brake is made from the same profile as that of carriage 50, comprising the same grooved guide and sliding means 92 of appropriate synthetic material such as nylon. Furthermore, the brake frame has two elongated countersinks 93 for the lodging of two brake shoes 94 and their shoe supporting connecting rods 95, and two openings 96 for the passage of control rods fixed to brake hooks 97. The system further comprises a mobile block 98 and a cover 99. Each brake shoe 94 is composed of a body 941 of aluminum, traversed by two pins 942 and 943 driven therein. There are furthermore two recesses 944 and 945 whose purpose will be described later. The braking portion of the shoes has a trapezoidal section 946 (FIG. 6) to come into contact with the grooves 28 of the rail 20. The supporting shoe rods 95 are of two types: the entrainment rods 951 and the entrainment and control rods 955. Each rod 951 or 955 has two cylindrical borings (952, 953; 956, 957).

The borings 952, 956 will receive the shoe pins 942 and 943 whereas the borings 953, 957 are freely traversed by the pins 911, 912 which are fixed to the brake frame 91. The entrainment and control rods 955 further comprise a hole 958 to receive the brake control hook 97. This hook 97 is composed of a shank 971 having a bent end portion 972 adapted to engage with the corresponding holes 958 in the control rod 955. Two helical springs 973 and 974 are placed on the shank 971 between an abutment 975 (a crimp fastening, for example) and a blocking element 976 (e.g. a nut screwed on the threaded lower end portion of the shank 971). The mobile block 98 comprises a passage 981 for the threaded crimp rod 132 fixed to the end 131 of the entrainment cable 13, a lodging 982 for a spring 983, and a bolt 984 for the fixation to the frame 91, as well as two passages 985 for the brake hooks 97, these passages forming a shoulder 986 against which springs 973 and 974 will abut. The cover 99 is to protect the different elements of the described parachute brake.

The assembling operations for the vertically displaceable installation support of the invention are effected with the pole laid down on the ground. On the pole head 30, the uppermost rail section 21 is screwed by the two centering screws 23. This rail section 21 is first provisionally fixed with a clamp or other appropriate tools, and it aligns itself automatically owing to its contact edges 29, and skill is to be taken to level the pole plate 11 with the pole head base 31. Then the four head adjustment screws 312 are pushed against the pole plate 11. The pole head 30 is now solidly fixed on the pole plate 11 by the four fixing bolts 311. The provisional fixing means (such as clamps) are withdrawn, and the upper rail section 21 is secured to the pole by the fixing screws 24. The housing of the stationary connector 41 is then provisionally attached. The such mounted and adjusted assembly allows to position the carriage 50 on the uppermost rail section 21, and to check:

the sliding motion of the carriage on the guide rail, the fine guidance of the carriage within the pole head, the plugging-in of the electric connections, and the motion of the carriage relative to the head.

When the tests are made, the stationary connector housing 41 is dismantled and the electric feeding connectors 141 and the entrainment cable 13 are drawn into the pole. The electric connections are made to the female multiple socket 43. The entrainment cable 13 is placed on the deflecting pulleys 32. These deflecting pulleys are fixed on their respective axles 322 and 326 by the bolts 328. The stoppers 324 and 327 are applied. The stationary connector housing is fixed by screwing with correct tightness. The electric feeding conductors 141 are attached and hooked by means of the ropes 341 and the hooks 33. The entrainment cable 13 which protrudes from the pole head 30 is left loose on the ground with its other end connected to the drum of an auxiliary winch. Then, the other sliding rail sections 21 are screwed on the pole in the number necessary to cover the desired guidance length, inserting two joining pins 26 between every two adjacent sections. Now the carriage 50 is positioned on the sliding rail 20, optionally together with its parachute brake. The upper end of the entrainment cable 13 is secured to the carriage 50 by the fixing elements 133.

Now the pole is erected and sealed, and the following operations can be effected on the ground:

electric connections in the shaft of the pole, mounting of the support material 80 of the installations, mounting of the installations and their electric connections in the mobile connector housing 45, optional adaptation of a winch, and test operations of the displaceable system.

For the displacement control of the mobile carriage and its parts, a hand operated or a motor driven winch can be used, optionally transportable and arranged to adapt to different openings of several poles. Of course, a traction movement of the cable 13 will raise the mobile carriage 50.

The principles for the locking and stabilizing as well as for the unlocking of the carriage will now be described with reference to FIGS. 10 and 11. Hooks 62 are held in a horizontal plane during the travelling movement of the carriage 50 alongside the rail 20, as shown in FIG. 10A. In this case the counterweight 71 remains vertical, and from the ground the red flag face 72 can be seen. When the hook 62 approaches the summit of the pole, the rounded pivotable end portion 622 abuts against the engagement angle 351, thus pivoting the hook 62 alongside the sliding plane 352 into vertical position whereas the counterweight 71, fixed to the same shaft as the hooks 62, comes into a horizontal position and shows its black face to the ground (FIG. 10B). Due to gravitational force, the counterweight 71 tends to pivot the shaft 61 in clockwise direction. The user will continue to apply, by acting on the winch, an ascending motion to the carriage until the rounded end portion 622 of the hook is engaged with the rounded abutting surface 353 of the hooks (FIG. 10C). In this position, the carriage is locked. When the user will loosen the cable by a countermovement of the winch, the carriage is biased to the front, due to the inclined position of the hooks, by a force proportional to the total suspended mass. The longitudinal front face 572 of the carriage will lean upon the longitudinal face 411 of the stationary conductor housing thus achieving the perfect stabilisation of the displaceable apparatuses or installations, especially preferred when these installations are, e.g., directional antennas. When the locked position of FIG. 10C of the carriage has been reached, the user will simultaneously see the red and black faces (72 and 73) of the counterweight 71. He is now safe to remove the entrainment cable 13 passing within the pole from the winch drum and hook it to a loop attached to the pole base, which will be a further security means to the attachment at the top of the pole. The mobile winch may then be removed from the pole.

For unlocking the carriage 50 from the pole head 30 (see FIG. 10D), the operator will apply an ascendent motion to the carriage by means of the winch, by about 8 mm, until the abutting surfaces 55 of the carriage push against the surfaces 358 of the pole head. During this motion, the hooks 62 leave their rounded abutting surfaces 353 under the effect of the counterweight 71 and pivot within the recesses 354 into a horizontal position. The counterweight 71 then shows its red face 72. The operator then knows that he can apply a downward movement; during this movement, the pivoting rounded end portion 622 of the hooks comes into contact with the angles of the abutment surface 353 and rotate the hooks and the counterweight 71 until the hooks 62 will take the vertical unlocking position (see FIG. 10E), at 180° to the vertical locking position of FIG. 10B. The hooks contact the sliding planes 352 of the pole head, and the counterweight, in its horizontal position, shows to the ground its large face of natural color not referenced in the drawing, thus showing to the operator that the unlocking phase has been reached. On leaving the pole head, the hooks will automatically take the position shown in FIG. 10A (red flag face 72 visible from the ground), and the lowering operation can be continued or a new locking phase can be started.

Referring to FIG. 10*d* which illustrates the unlocking phase of the preferred embodiment, when the abutting surfaces 55 of the carriage 50 push against the surfaces 358, a lateral face of the hook 62 abut against an upper scaled face of the recess 354. The upper scaled face is provided to slightly rotate the hook 62 about its axis 61 to avoid jamming of the movable parts of the unlocking means.

It should be noted that the locking and stabilising system of the invention only comprises four particularly simple parts: the two hooks 62, the shaft 61 and the counterweight 71. The arrangement of these components allows to achieve a particularly optimal mechanical resistance compared with their dimensions. In spite of this simplicity, the system has several important features:

easy maintenance since there remains no mobile part at the top of the pole, reliability based directly on simplicity, especially absence of any springs, simplicity of the locking or latching and unlocking operations, effected solely by the use of a winch and monitored by the colors of the counterweight, witness of the different phases.

When the carriage is in its locked and stabilised phase, it is important that the female and male sockets 43 and 47 are in perfect engagement, and that the gasket 451 contacts with appropriate force the surface 414 of the housing 41. Furthermore, the sliding assembly is displaced, in the unlocking phase, upwardly by about 8 mm whereas the mobile connector housing 45 remains pushed against the housing 41.

The sliding device of the mobile connector support 45 allows, on one hand, by the compression of its spring 496 during the end of the lifting phase of the carriage 50, to obtain a sufficient force for the engagement of the male contacts into the corresponding female ones, and, on the other hand, a good contact force of the gasket 451 on the surface 414, and finally to effect the unlocking operation.

The male and female connectors used were Amphenol sockets, but other sockets may be used as well. Dimensional and electro-mechanical modifications may be introduced without departing from the scope and spirit of this invention.

Regarding the system of the parachute brake shown in FIG. 6 to 9, it is used to capture and hold the sliding assembly alongside the pole during the lifting and lowering operations, should the cable break. During these operations, the sliding mass (carriage plus supports plus use installations) is suspended at the end of the cable 131 which compresses the spring 983 via the threaded pinching rod 132, the fixation elements 133, and the control block 98. On a cable breakage, the block 98 comes from the traction position of FIG. 8 into the position of FIG. 9 under the action of the spring 983 which expands between the lodgment 982 and the brake frame 91. This expanding motion displaces the rod 971 of the brake hook, and under the action of the spring pair 973 and 974, the bent over end 972 of the rod changes the control rod 955 from its position shown in broken lines to the position shown in plain lines in FIG. 9. Springs 973 and 974 will compensate for the differences of the paths made by the control block 98 and the attachment points 958 of the control hooks 97 on the control rods 955. Should the cable 13 break or only loosen, the brake shoe 94 is brought into contact with the trapezoidal groove 28 of the sliding rail 20. From this description follows the advantage of the trapezoidal shape given to the shoe, on one hand, and to the rail groove on the other hand, in view of substantially doubling the frictional surfaces within the same space and, for the same perpendicular force to the sliding rail applied by the brake shoe, a vertical frictional force due to wedge effects of about 8 to 10 times can be obtained, compared with brake surfaces free from wedging effects.

This important improvement of frictional forces allows during the brake contact of the shoe 94, the formation of a relatively great angle $\alpha$ (about 15°) between the horizontal plane and the line passing through the axes of the borings 952 and 953. This fact is interesting for two reasons:

the elimination of the danger that the brake shoe 94 may derive from the rail when the angle $\alpha$ has changed to 0°, and no high precision necessary during machining.

It should be noted that, when the angle $\alpha$ is 0°, the upper portion of the shoe 94 comes into contact with the surface 913 of the frame 91 which establishes an additional safety.

The recesses 944 and 945, milled into the shoe 94, permit a maximum remoteness from the rail and allow the use of transversal shafts 911 and 912 which are particularly well supported in the frame 91. In the foregoing description, only one brake shoe and one control shaft are mentioned, but as shown in the drawing, the system can be duplicated.

As it has already been said, the system described above for a vertically displaceable lighting may be used for any other installation types, for example those listed in the introduction.

Furthermore, the vertically displaceable installation support may also be mounted on a frontage of buildings instead of on a pole. The pole may also be inclined to the vertical plane, even curved, and in these cases, some components would have to be modified without departing from the spirit of the instant invention, since the principal features remain the same.

I claim:

1. A device for supporting an installation vertically displaceable alongside a profile, comprising:

(a) an elongated carriage adapted to support said installation and including locking, stabilizing, and unlocking means in the raised end position of the carriage, (b) carriage entrainment means comprising a cable which cooperates with said locking, stabilizing, and unlocking means of said carriage, (c) a slide rail for the carriage situated at the exterior of said profile substantially in vertical position, including at least one groove adapted to cooperate at least indirectly with a brake system fixed on said carriage, and (d) a head mounted at the summit of said profile, said carriage entrainment means as well as electrical conductors passing through the interior of said profile, characterised by the fact that said carriage comprises male electric connection means and said head comprises female electric connection means cooperating with said male connection means, that said slide rail is connected to said head, and that said head includes position adjusting means relative to the end portion of said slide rail and fixed elements adapted to cooperate with said locking, stabilizing, and unlocking means of said carriage.

2. The device of claim 1 wherein said carriage (a) is provided with a passageway adapted to guide said entrainment cable.

3. The device of claim 1 wherein the mobile entrainment cable end is fixed to the carriage base structure in a manner allowing a cable change without dismantling the carriage.

4. The device of claim 1 wherein said carriage comprises a block slidingly adapted to said slide rail, said block being provided with a transversal boring receiving an entrainment shaft adapted to pivot locking and stabilizing means as well as unlocking means.

5. The device of claim 1 wherein said carriage is made by extrusion of a light metal.

6. The device of claim 4 wherein said locking, stabilizing, and unlocking means comprise at least one pivoting hook rigidly connected to said entrainment shaft and pivoting together with said shaft.

7. The device of claim 6, further comprising a counterweight rigidly connected to said entrainment shaft and adapted to put into motion said pivoting hook by gravitational forces.

8. The device of claim 1 wherein said head includes recesses shaped to move said hook in its locking, stabilizing, and unlocking positions.

9. The device of claim 1, wherein said device is adapted to support said installation at a height of about 15–20 meters.

10. The device of claim 1, wherein said device further comprises means for operating said entrainment means by a mobile winch through an opening in the profile.

11. The device of claim 1, wherein said carriage includes first surfaces, wherein said carriage includes a hook, wherein said hook is rotatable about an axis, wherein said hook includes a lateral face, wherein said head includes first surfaces, wherein said head includes a recess, and wherein said head includes an upper scaled face; said unlocking means being operated by pushing said first surfaces of said carriage against said first surfaces of said head while simultaneously abutting said lateral face of said hook against said scaled face, whereby said hook can be slightly rotated about said axis to avoid jamming of said unlocking means.

12. A device for supporting an installation vertically displaceable alongside a profile, comprising:

(a) an elongated carriage adapted to support said installation and including locking, stabilizing, and unlocking means in the raised end position of the carriage, (b) carriage entrainment means, (c) a slide rail for the carriage situated at the exterior of said profile substantially in vertical position, including at least one groove adapted to cooperate at least indirectly with a brake system fixed on said carriage, and (d) a head mounted at the summit of said profile, said carriage entrainment means as well as electrical conductors passing through the interior of said profile, characterized by the fact that said carriage comprises male electric connection means and said head comprises female electric connection means cooperating with said male connection means, that said slide rail is connected to said head, and that said head includes position adjusting means relative to the end portion of said slide rail and fixed elements adapted to cooperate with said locking, stabilizing, and unlocking means of said carriage; and wherein said slide rail is composed of a plurality of successive sections in end-to-end relationship; and wherein said rail sections are provided with joining elements at their ends adapted to solidly and rigidly join two adjacent rail sections; and wherein each joining element comprises at least one groove provided in the length of the rail section and adapted to receive a joining pin connecting two adjacent rail sections.

13. A device for supporting an installation vertically displaceable alongside a profile, comprising:

(a) an elongated carriage adapted to support said installation and including locking, stabilizing, and unlocking means in the raised end position of the carriage, (b) carriage entrainment means, (c) a slide rail for the carriage situated at the exterior of said profile substantially in vertical position, including at least one groove adapted to cooperate at least indirectly with a brake system fixed on said carriage, and (d) a head mounted at the summit of said profile, said carriage entrainment means as well as electrical conductors passing through the interior of said profile, characterized by the fact that said carriage comprises male electric connection means and said head comprises female electric connection means cooperating with said male connection means, that said slide rail is connected to said head, and that said head includes position adjusting means relative to the end portion of said slide rail and fixed elements adapted to cooperate with said locking, stabilizing, and unlocking means of said carriage; and wherein said carriage entrainment means comprises a cable cooperating at least indirectly with said carriage and adapted to realize the different locking, stabilizing, and unlocking operations of said carriage; and wherein said carriage comprises a block slidingly adapted to said slide rail, said block being provided with a transversal boring receiving an entrainment shaft adapted to pivot locking and stabilizing means as well as unlocking means; and wherein said locking, stabilizing, and unlocking means comprise at least one pivoting hook rigidly connected to said entrainment shaft and pivoting together with said shaft; and further comprising a counterweight rigidly connected to said entrainment shaft and adapted to put into motion said pivoting hook by gravitational forces; and wherein said counterweight is adapted to serve as a positional flag to show to an operator the position of said carriage and of said locking, stabilizing, and unlocking elements.

14. The device of claim 13 wherein said counterweight has a parallelipiped shape and comprises differently colored lateral surfaces.

* * * * *